United States Patent [19]

Carpenter

[11] Patent Number: 4,606,284

[45] Date of Patent: Aug. 19, 1986

[54] UNDERFEED STOKERS

[75] Inventor: Brian M. Carpenter, Cheltenham, England

[73] Assignee: Coal Industry (Patents) Limited, England

[21] Appl. No.: 475,392

[22] Filed: Mar. 15, 1983

[30] Foreign Application Priority Data

Apr. 6, 1982 [GB] United Kingdom ..... 8210129

[51] Int. Cl.[4] ..... F23M 9/00

[52] U.S. Cl. ..... 110/318; 110/310; 110/322; 126/92 B; 126/92 C; 126/141; 431/171; 431/347

[58] Field of Search ..... 110/101 R, 104 R, 104 B, 110/105.6, 297, 298, 305, 309, 310, 322, 110, 318, 319; 431/171, 285, 347; 126/92 B, 92 C, 141, 112

[56] References Cited

U.S. PATENT DOCUMENTS

| | | | |
|---|---|---|---|
| 3,909,188 | 9/1975 | Velie | 431/285 |
| 4,092,094 | 5/1978 | Lingl, Jr. | 110/104 R |
| 4,134,719 | 1/1979 | Velie | 431/171 |
| 4,241,670 | 12/1980 | Blaskowski | 110/104 R |
| 4,299,177 | 11/1981 | Mros | 110/110 |
| 4,377,116 | 3/1983 | Satake | 110/110 |
| 4,426,937 | 1/1984 | Sietmann et al. | 126/112 |

FOREIGN PATENT DOCUMENTS

| | | | |
|---|---|---|---|
| 3042381 | 6/1982 | Fed. Rep. of Germany | 126/141 |
| 1189836 | 4/1970 | United Kingdom | 126/141 |

*Primary Examiner*—Albert J. Makay
*Assistant Examiner*—Steven E. Warner
*Attorney, Agent, or Firm*—Stevens, Davis, Miller & Mosher

[57] ABSTRACT

The underfeed stoker has a retort (6) which is located at a height 'h', an arch having a minimum width 'w'. The ratio of the minimum width 'w' to the height 'h' is greater than 1.5 and less than 2.

4 Claims, 3 Drawing Figures

UNDERFEED STOKERS

This invention concerns improvements in or relating to underfeed stokers.

Various attempts have been made to improve the combustion efficiency of underfeed stokers, their amenity and capacity to burn a variety of fuels.

One proposal made some years ago involved the disposition of an arch above the retort of the stoker, an object being to reflect heat radiated from the fuel bed thereby enhancing combustion and ignition of green coal emerging from within the retort.

It has been found that by adopting a particular orientation in relation to the grate, an arch can have added effect.

An object of the present invention is therefore to provide an improved underfeed stoker incorporating an arch disposed in a manner to improve combustion efficiency.

Accordingly the invention provides an underfeed stoker including a retort having a tuyere with ports, and an arch located above and spaced from the retort wherein the ratio of the minimum arch width to the height of the arch above the tuyere is greater than 1.5 and less than 2.

For the purpose of this specification, the minimum arch width dimension corresponds to the distance between the tuyere ports taken across the width of the retort. Where more than one row of tuyere ports is provided, the distance will be that between the outermost ports.

The retort may be circular, square or rectangular. The angle subtended between an imaginary line drawn from the row of tuyere ports and the center of the arch and the horizontal lies conveniently in the range 45° to 53°. By way of example only, an underfeed stoker according to the invention is described below with reference to the accompanying drawings in which.

Figure 1:
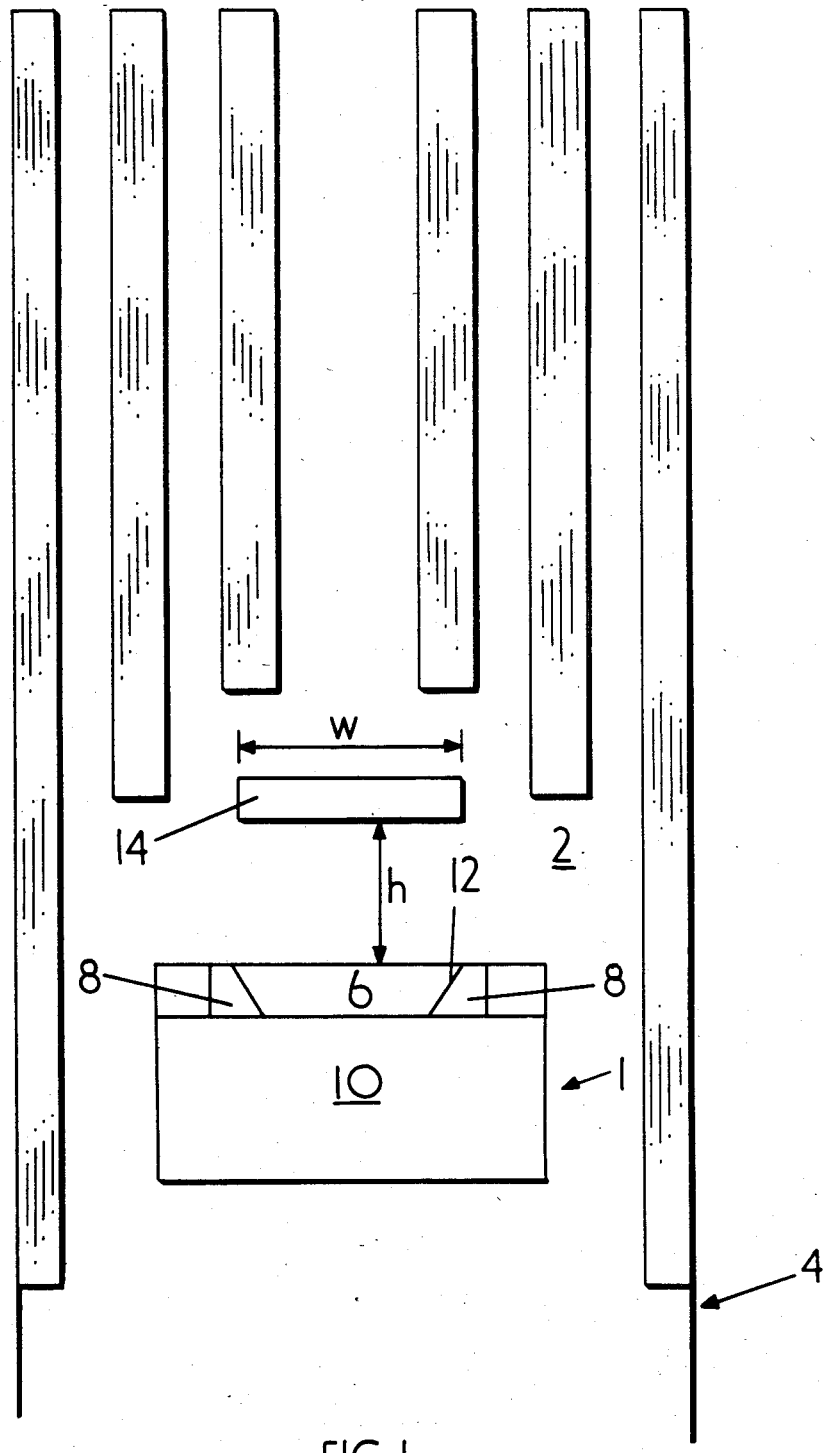
FIG. 1 is a diagrammatic cross-section of the boiler showing an underfeed stoker.

Referring to FIG. 1, an underfeed stoker is disposed within the combustion chamber 2 of a boiler 4. The stoker 1 includes a retort 6 having tuyeres 8 and mounted over a plenum 10. The tuyeres 8 have ports 12 and at a height 'h' above the topmost ports 12 is located an arch 14 of refractory or ceramic material. Alternatively, the arch 14 may be made of metal. The minimum width of this arch is designated 'w' and is equivalent to the distance between tuyere ports on opposite sides of the retort. The ratio of the width 'w' to the height 'h' lies in the range 1.5 to 2. Thus for a given size of retort, the desired height of the arch can easily be determined to give the best results.

It may be appreciated that the actual width of the arch 12 may in practice exceed the minimum dimension.

Figure 2:
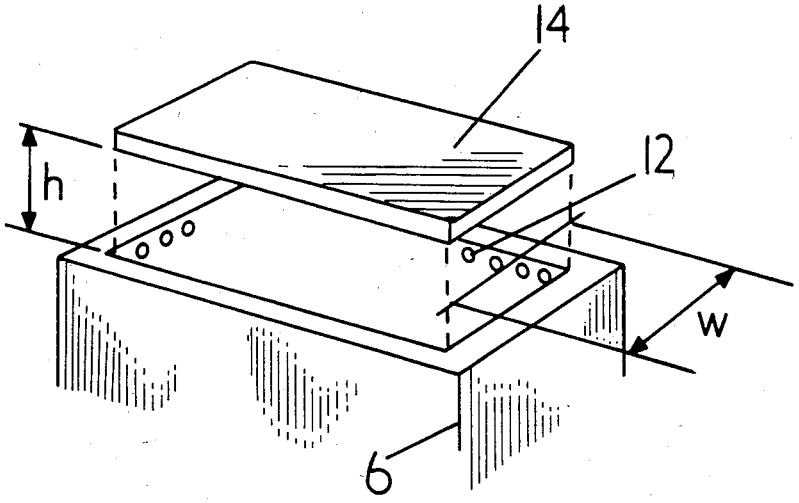
FIG. 2 is a diagrammatic isometric view showing an underfeed stoker of rectangular form.
Figure 3:
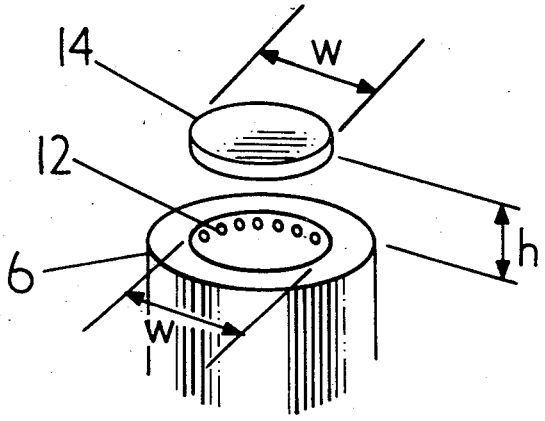
FIG. 3 is a diagrammatic isometric view showing an underfeed stoker of circular form.

FIGS. 2 and 3 show respectively rectangular and circular form retorts and appropriately shaped arches.

There are important advantages to the use of an overfire arch of the kind shown and located at a height determined by the ratio. Combustion is improved significantly as is efficiency, while there is reduced coke formation and lower carbon losses, the arch acting not only as a heat reflector but also as a particle deflector. The flame length is reduced and accordingly the combustion chamber and boiler arrangement can be made compact. Furthermore, the range of solid fuels is broadened by employing the present invention, and the start-up procedure is improved.

I claim:

1. An underfeed stoker including a retort for combusting solid fuel and having a tuyere with port means, and an arch for reflecting heat and deflecting combustion products located vertically above and spaced from the retort, wherein the ratio of the minimum arch width to the height of the arch above the tuyere is greater than 1.5 and less than 2.

2. An underfeed stoker according to claim 1 in which the arch has a minimum width dimension corresponding to the distance between the tuyere port means taken across the width of the retort.

3. An underfeed stoker according to claim 1 in which both the retort and the arch are generally circularly shaped.

4. An underfeed stoker according to claim 1 in which both the retort and the arch are generally rectangularly shaped.

* * * * *